US006286428B1

(12) United States Patent
Madsen

(10) Patent No.: US 6,286,428 B1
(45) Date of Patent: Sep. 11, 2001

(54) METHOD FOR PRINTING OF PACKAGING PARTS

(76) Inventor: Erik Hougaard Madsen, Kallerupvej 5, DK-4400, Kalundborg (DK)

( * ) Notice: Subject to any disclaimer, the term of this patent is extended or adjusted under 35 U.S.C. 154(b) by 0 days.

(21) Appl. No.: 09/453,433

(22) Filed: Dec. 2, 1999

Related U.S. Application Data

(63) Continuation-in-part of application No. 09/078,385, filed on May 13, 1998, now abandoned.

(51) Int. Cl.[7] ..... B41F 1/34

(52) U.S. Cl. ..... 101/485; 101/227; 53/131.5; 53/411

(58) Field of Search ..... 101/485, 35, 37, 101/227, 228, 235; 53/131.2, 131.3, 131.4, 131.5

(56) References Cited

U.S. PATENT DOCUMENTS

| | | | | |
|---|---|---|---|---|
| 2,175,338 | * | 10/1939 | Booth | 101/227 |
| 3,282,202 | * | 11/1966 | Groth et al. | 101/37 |
| 3,662,571 | * | 5/1972 | Eliasberg | 53/411 |
| 3,735,697 | * | 5/1973 | Provan | 101/37 |
| 4,033,254 | * | 7/1977 | Tobey et al. | 101/235 |
| 4,271,757 | * | 6/1981 | Maxwell et al. | 101/37 |
| 4,655,026 | * | 4/1987 | Wigoda | 53/131.3 |
| 4,739,604 | * | 4/1988 | Natterer | 53/131.5 |
| 4,753,059 | * | 6/1988 | Natterer | 53/131.5 |
| 5,852,915 | * | 12/1998 | Williams et al. | 53/411 |
| 5,884,451 | * | 3/1999 | Kano et al. | 53/411 |

FOREIGN PATENT DOCUMENTS

| | | | |
|---|---|---|---|
| 2021917 | * | 12/1971 | (DE) . |
| 172268B1 | * | 2/1998 | (DK) . |
| 870611 | * | 10/1998 | (EP) . |

* cited by examiner

*Primary Examiner*—Eugene Eickholt
(74) *Attorney, Agent, or Firm*—William J. Sapone; Coleman Sudol Sapone, P.C.

(57) ABSTRACT

A method for printing packaging parts which constitute a part of a continuous web of foil 1, in that the individual packaging parts 2 lie at a distance from each other and are in connection with each other via the foil, whereby the continuous web of foil with the packaging parts is fed forward to a printing section B, where the printing of the packaging parts 2 is effected with print-pads 10, and each printing cycle comprises a packaging part or several packaging parts lying parallel and at the side of each other with a distance between them, and the position of the parts being sensed at an entrance to the printing station, a controller receiving a signal from the position sensor and calculating an amount of movement for precisely positioning the packaging parts for printing, and controlling a drive for the foil web to assure that the packaging parts are moved to the calculated position for printing.

17 Claims, 5 Drawing Sheets

METHOD FOR PRINTING OF PACKAGING PARTS

This application is continuation in part of Ser. No. 09/078,385, filed May 13, 1998 and now abandoned.

BACKGROUND OF THE INVENTION

This invention concerns a method for the printing of packaging parts. In connection with dry offset printing of packaging parts, particularly plastic lids, it is commonly known to feed the lids individually via carriers/chain cassettes, in which the individual lid parts are placed. These are fed forward to a printing section where the dry offset printing takes place. The carriers are disposed on chains at a distance corresponding to about the length of two lids. Normally, there are 20 to 30 carriers for conveying the lids from the insertion stacks and forward to the restacking. Before the printing, there is thus performed a punching out of the lids and a stacking operation. The actual printing is effected by feeding a single lid forward with the carriers to the printing section, where a printing pad is fed down on to the surface of the lid to deposit its print. The packaging is then conveyed further and, after having been dried, a stacking takes place.

This known technique thus suffers the disadvantage that it involves two stacking operations, and also that the printing is carried out on the individual lids when these are fed forward in cassettes. With the known methods, the 30 lids are mounted singly in cassettes from which they are hereafter removed again. This means that a lot of mechanics are involved in the form of stacking, and re-stacking the cassettes. In practice, this means that the stability is not satisfactory when the speed needs to be high. Consequently, the process is inexpediently resource demanding, time-consuming and costly.

It is known from 3,539,085 to guide foils in the form of webbing through, for example, a printing press, and where among other things the control system takes into account and controls the tensions in the webbing by controlling the speed of the rollers. The method does not solve the problem involved in the placing of print on the packaging parts, which packaging parts are not produced in one plane and are consequently unsuitable for the mass production as described in the publication.

From WO 91/15342 there is known an apparatus and a method for the placing of irregularly demarcated pictures on a foil. The publication does not solve the problem involved in the clear control of the individual parts which are desired to be provided with print, and consequently does not permit a mass production in connection with the packaging parts.

Another problem with the printing of lids is that it is difficult to attain high line speeds due to inaccuracies in the positioning of lids on the foil web. According to the prior art, corrections must be made to adjust for these positioning inaccuracies, with consequent delays in production, as the foil web must be adjusted to assure accurate printing on the parts. This may generally require the foil web to move backwards as well as forwards with consequent delays in production.

SUMMARY OF THE INVENTION

It is the object of the invention to provide a method which is not encumbered with the disadvantages of the known technique, and thus where it is not necessary to stamp-out the packaging before it is printed, and whereby a rational handling of the packaging parts with a minimum of operations is achieved. Further, an object of the invention is to provide an improved method for advancing the foil web so as to stop the web for printing in relation to the actual position of the lids, thereby avoiding the need to adjust for lid position inaccuracies.. It is another object to automatically and periodically determining the position of the lids as they are fed on the foil web.

This object is achieved by a method where the packaging parts comprise a part of a continuous web of foil, the individual packaging parts lying at a distance from one another and are in connection with one another via the foil web, feeding the continuous foil web with the packaging parts forward to a printing section where the printing of the packaging parts takes place in the printing section with printing pads, sensing a leading edge of the packaging parts at the entrance to the printing section, calculating a position advancement necessary for proper positioning for printing, moving the packaging parts to the calculated position, controlling the printing press in response to the sensed edge and printing the packaging parts lying parallel at the side of one another with a distance between them. The packaging parts are then fed forward to a separation section where the individual packaging parts are separated from the foil web by a separation process, and another set of packaging parts are fed forward until they reach the sensing means at the entrance to the printing station, to start another cycle.

The foil web with the formed packaging parts is conveyed directly forward to the printing section, whereby the necessity is avoided of having to stack and subsequently place the packaging parts in the cassettes, which will then transport these forward to the printing section in the manner which is commonly known. The printing according to the invention takes place down in the packaging parts, which can lie expediently along the same line seen in the transverse direction. The foil is hereafter positioned in relation to the next row of printing pads, so that the next transversely-lying row of packaging parts is placed opposite the next row of printing pads. The printed packaging parts are removed from the foil web by a separation process at a time at which the foil web part with the printed data is stationary, and the packaging part can now be stacked or handled as required, in that it is now ready for use.

The process is thus characterized by being a continuous process, where the need for manual operation is minimal.

By using the method according to the invention, there is achieved an expedient and definite positioning of the packaging in relation to the printing station, where the sensor means controls the printing in response to the position of the packaging parts on the foil web so that a high production of printed packaging is possible.

Further, there is disclosed, an expedient configuration of the printing section which makes it possible to effect a high production of the printed packaging parts per unit of time.

By using the method according to the invention as disclosed, an effective and time-saving printing of packaging parts is achieved when, as disclosed, these are formed in plastic material and comprise the lid parts. It is also achieved that the packaging parts can be formed closely at the side of one another in the foil web, in that the positioning movement ensures that there is room for the subsequent print-pad section in the subsequent packaging part's section.

The method also achieves, by means of optical or mechanical sensors, to sense the front edge or the rear edge of the individual packaging parts, and then to calculate to proper movement of the foil web to bring the packaging parts to the correct position for printing. A CNC system regulates the motors for the driving of the foil web as a function of the signal from the sensing means to locate the items in correspondence with the print pads.

BRIEF DESCRIPTION OF THE INVENTION

The invention will now be described in more detail with reference to the drawing, in that FIG. 1 shows a side view of the process in outline form, FIG. 2*a* shows the printing process, FIG. 2*b* shows the printing roller with print pads and FIG. 2*c* shows a top view of the foil web.

DETAILED DESCRIPTION OF THE INVENTION

The various stages involved in the production of a printed packaging part appear in FIG. 1*a,* which shows section A comprising the forming of lids from a roll of foil 17 by a thermoplastic molding process. The feeding can also be effected directly from an extruder. Typical materials are polypropylene (PP), polystyrene (PS), polyethylene (PE) and polyvinylchloride (PVC), which in the heated condition, for example by a vacuum-or pressure-molding process, is formed into the desired product. Hereafter, the foil web with the formed packaging parts is led to the printing section B, and in order to avoid that the handling of the foil from the one section is imparted to the second section, the foil 1 with the packaging parts hangs expediently down in an arc.

In connection with the printing of the packaging, a semi-manual process stage M is incorporated for the adjustment and control of the colors. After printing, the foil and packaging parts are conveyed further to the drying section C and thereafter further to the separation section D, where the punching-out of the packaging parts is performed. Hereafter, a manual or automatic handling M' of the packaging parts is carried out, for example in the form of stacking, packing, etc.

Before printing, certain foils—especially PP—must be exposed to a heating T, whereby the surface tension of the foil is adjusted. The heating can be effected either as gas or electrical heating.

Figure 2A:
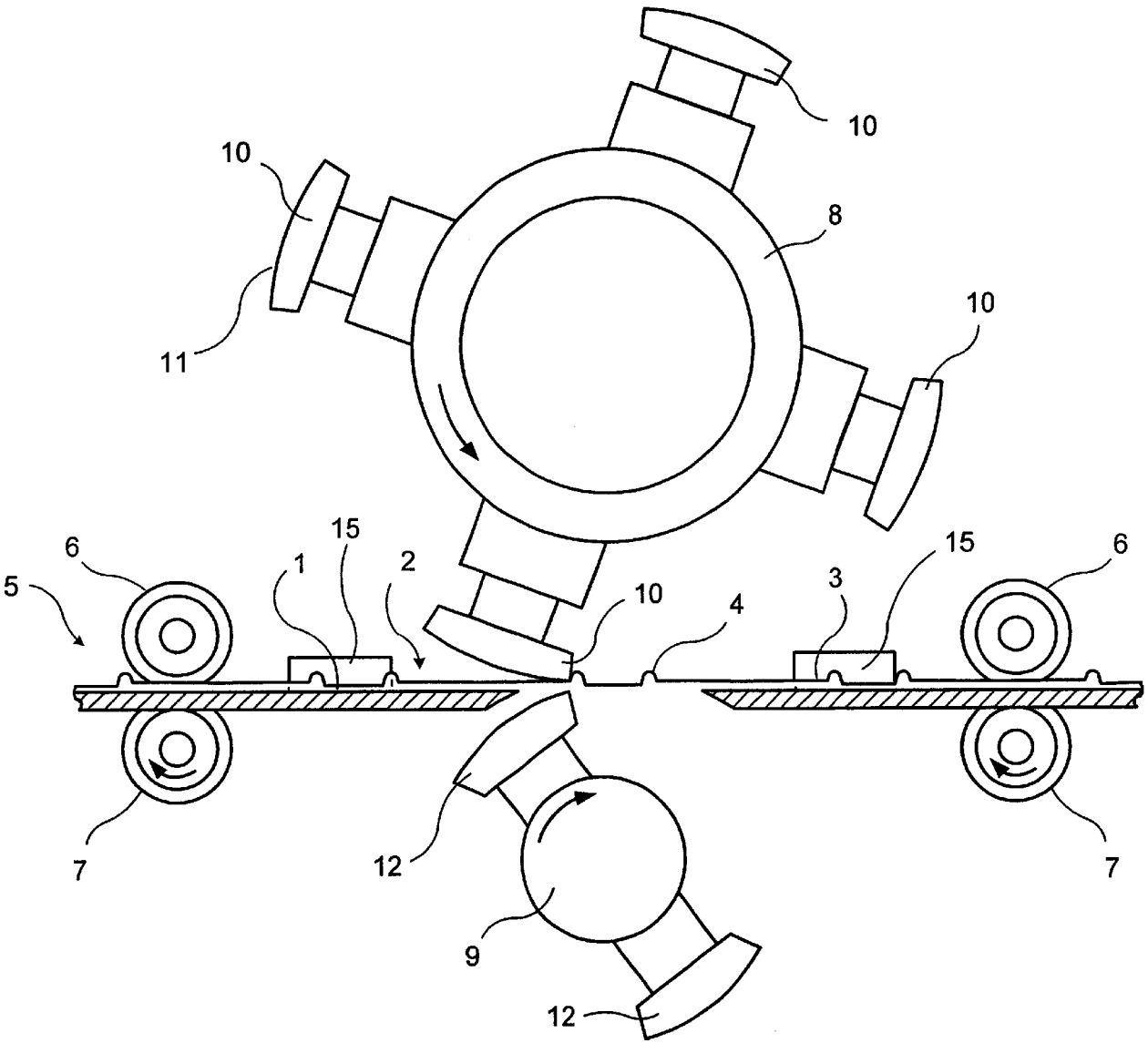

The printing section will be described in more detail with reference to FIG. 2*a,* which shows a foil web 1 with packaging parts 2 which, in this case, are packaging lids which comprise a central surface 3 on which the printing is to be applied, plus a surrounding edge 4.

The foil web is fed forward by means of gripping elements 5 which consist of two upper wheel sets 6 and two lower wheel sets 7, comprising eight wheels in all. The upper wheel set 6 is spring-loaded and presses against the upper side of the foil opposite the place where the lower wheel set 7 lies up against the underside of the foil web 1. The wheel sets are disposed between the individual lid tracks or at each side outside the outermost lid tracks. The lower set of wheels 7 are locked together mechanically and driven by a highly dynamic motor, which thus regulates the forward feeding and the return movement of the foil web simultaneously with the gripping of the foil web.

However, the number of wheel sets can vary from one set of wheels up to several, depending among other things on the number of rows, the weight of the foil and the speed at which it is fed.

Depending on the configuration of the lid parts, guide rails 15 are provided on the upper or the underside of the foil web 1, said rails extending up between two rows of packaging parts or at each side outside the outermost rows of packaging parts, ensuring lateral stability of the foil web. Long guide rails can also be mounted if they are required. The rails can be disposed between the wheel sets 6 or on the outer side in relation to these wheels.

The printing equipment comprises a printing roller 8 and a counter-pressure roller 9. The printing roller 8 is provided with print-pads 10, preferably four print-pads placed on the same circumference of the roller's periphery and displaced 90° from each other. However, the number can vary from a single pad to several, depending among other things on the foil part which is to be printed. Several rows of print-pads lying at the side of one another, preferably four, may be provided. The print-pads are expediently placed so that they form rows lying parallel with the center axis of the roller.

The actual surface 11 of the print-pads, which must apply the printing and which deposits the ink from so-called block rollers, is slightly convex. The printing is the so called dry offset printing. By means of a CNC system, it is ensured that the speed of the surface 3 of the lid when the offset print is applied corresponds to the peripheral speed of the print-pad 10, in that the print-pad 10 runs as master, and the motor which regulates the feeding speed of the foil runs as so-called slave in relation thereto. The motor for the foil web and the motor for print-pads and inking devices are appropriately controlled via a multi-spindled servomotor control similar to those used on CNC machine tools, robots, etc. It is herewith possible to handle the foil web with reciprocating movements, adjustment of speed, position, etc., so that this is synchronized electrically together with the current position and speed of the print-pad.

In order to ensure a certain printing pressure, a roller 9 equipped with counter-pressure dollies 12, preferably two dollies displaced 180° in relation to each other on the same peripheral circumference, are provided under the foil. The number of rows which follow the circumference of the roller 9 corresponds to the number of rows of print-pads, whereby the counter-pressure dollies are eight in number when there are sixteen print-pads. The speed of the counter-pressure dollies is adjusted in accordance with the speed of the print-pads, so that the dollies 12 serve to provide a counter-pressure when the offset printing is applied to the packaging, and lie directly opposite the print-pads 10 when these apply their print, and have the same peripheral speed as the print-pads 10. The cycle time can be as short as approximately 500 milliseconds, which corresponds to 120 cycles per minute. If four print-pads are used in a transverse row, it will thus be possible to print up to approx. 28,800 lids per hour.

When a transverse row of lids 14 has been printed, the foil web is fed backwards slightly, in that the next row of packaging parts lies so close to the printed packaging parts that there will not be room for the print-pad to apply its print correctly in the new row of lid surfaces. Sensors 16, preferably optical sensors, for example light diodes or lasers, register the front edge and/or the rear edge of the packaging, from the top or sides of the foil web as described below.

Figure 2B:
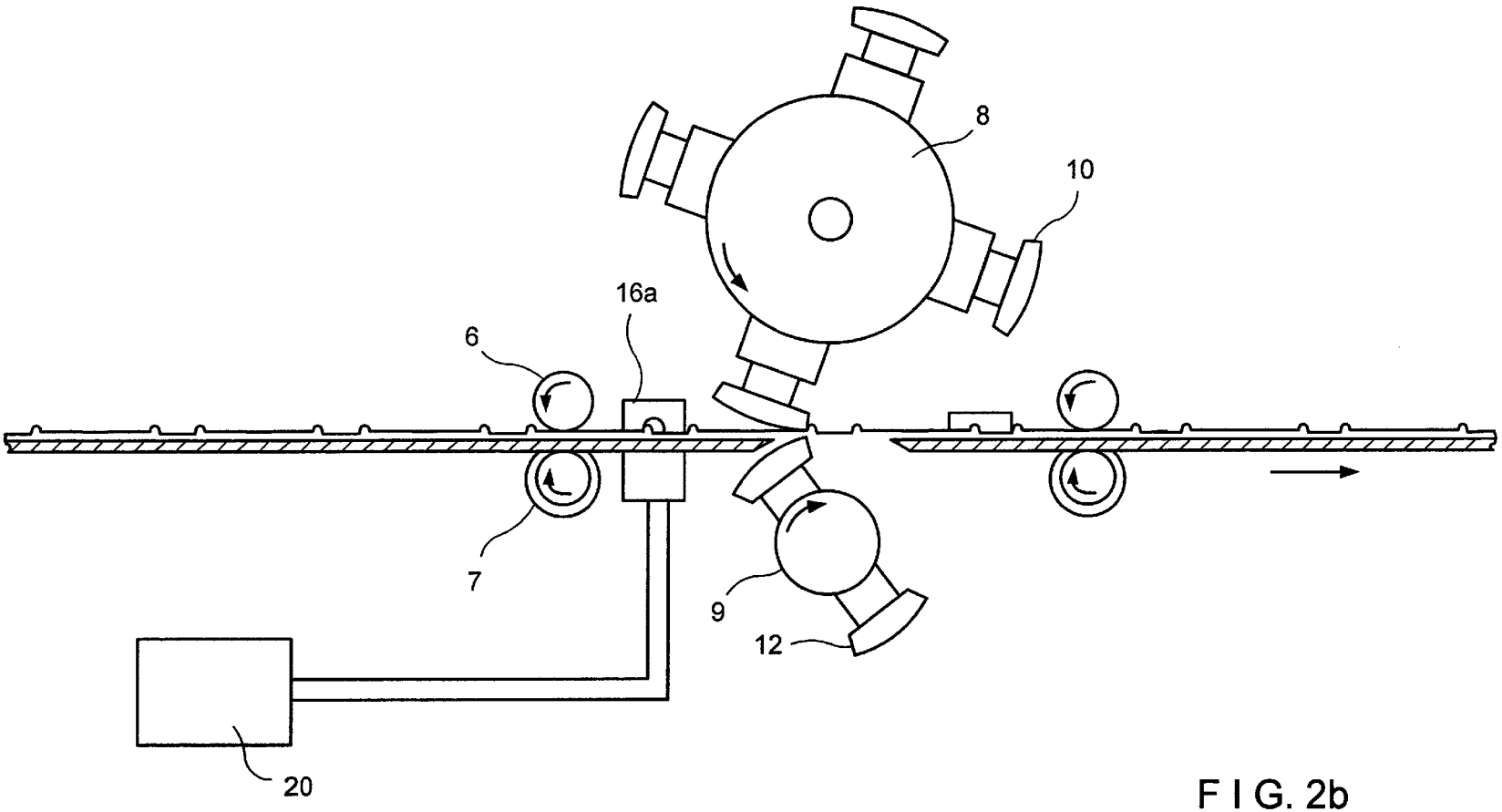
Figure 2C:
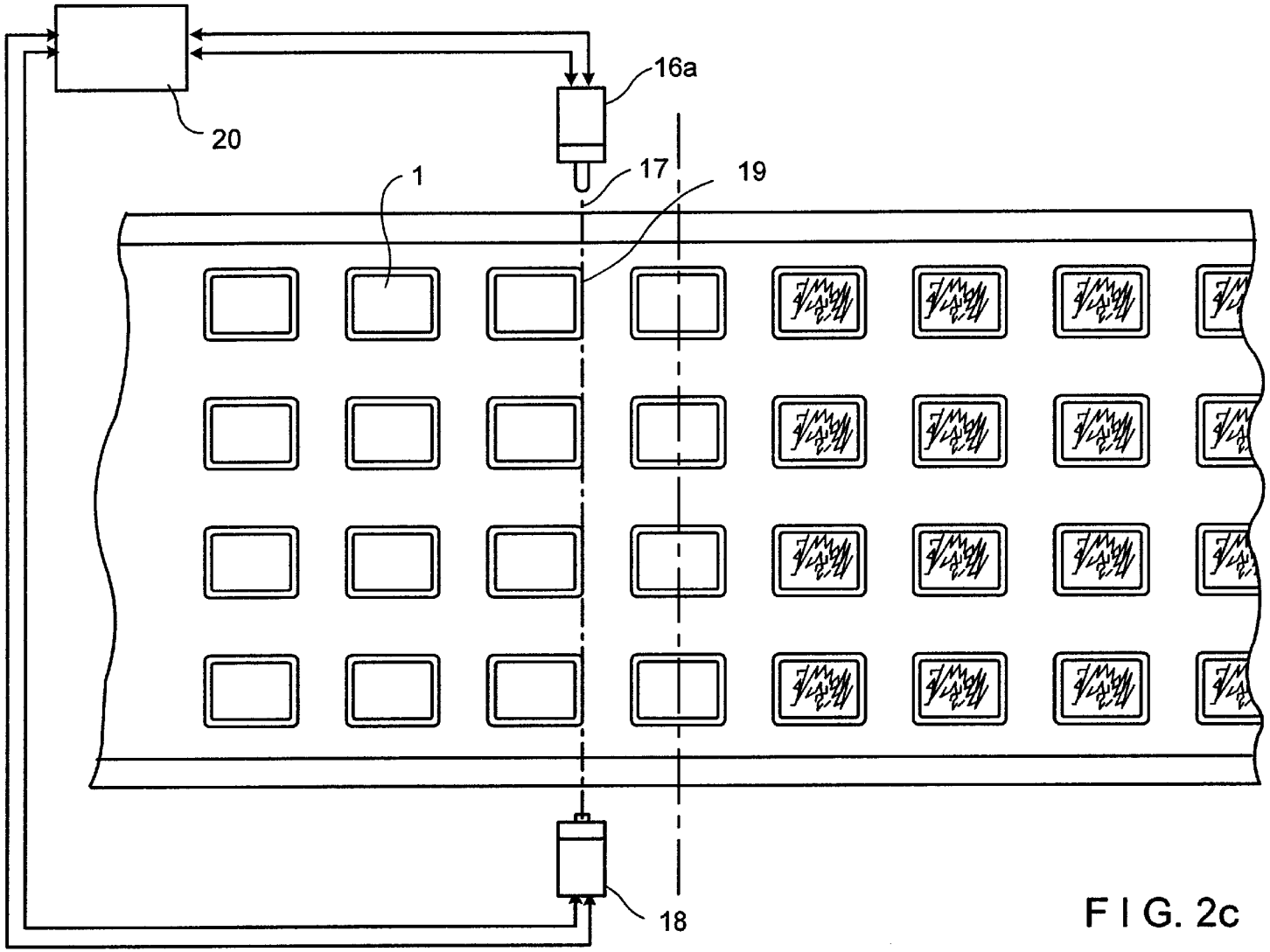

With reference to FIGS. 2*b* and 2*c,* a light source 16*a* is disposed to one side of the foil web for emitting a beam 17 that is received by a light detector 18. This is done at the entrance to the printing station. A front edge 19 of the packaging parts is detected by the light beam such that an impulse is sent to a controller 20 that calculates the position necessary for advancement of the packaging parts into the printing station. The controller instructs the printing motor to move the packaging parts the calculated amount so that precise positioning of these is assured. The printing roller then is activated to print the packaging parts. After three rows of the lids are printed, the foil web advances until the three printed rows are removed and three blank rows are positioned for printing by the print roller, a forward edge of the next set of three rows having been sensed by the light beam to synchronize with the action of the print roll.

Figure 3:
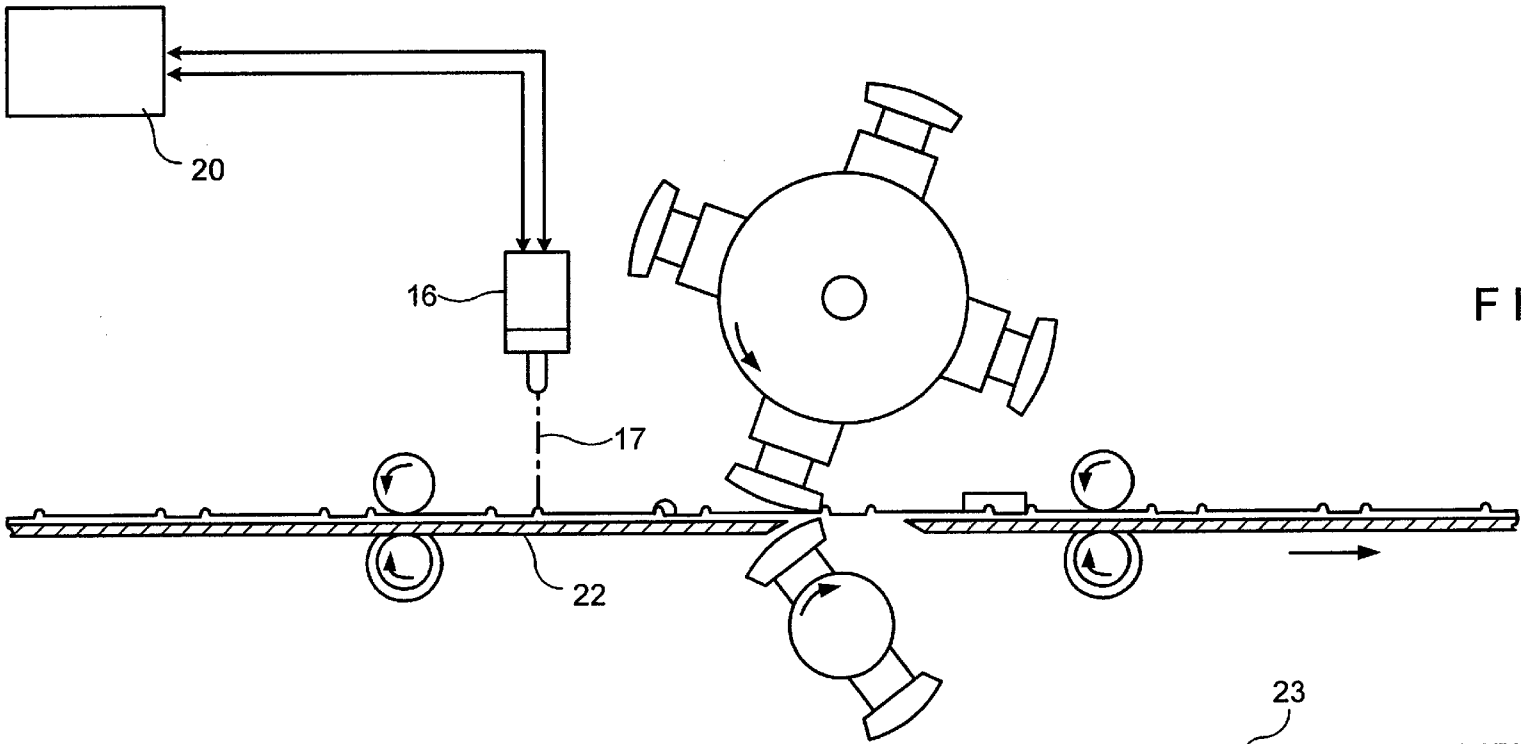
FIG. 3 shows an alternative embodiment of the invention.

With reference to FIG. 3, another embodiment of the invention is shown, usable with transparent packaging parts that may not properly activate the sensing beam due to their transparency. In this embodiment, a light source 16*b* issues the beam 17, with the light reflected back to the source used to determine the packaging parts position. The light beam is reflected back from a planar top surface of a rear edge 22 of the packaging parts, with the position information used by the controller to calculate the amount of advancement needed to accurately position the packaging parts.

Figure 4:
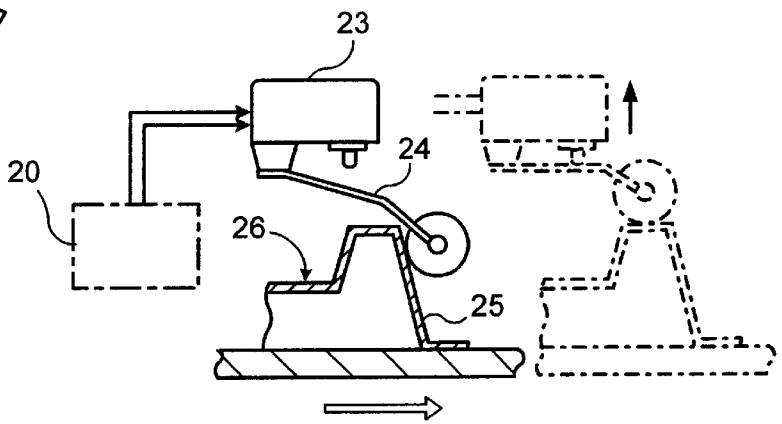
FIG. 4 shows another alternative embodiment of the invention.

In FIG. 4, another alternative embodiment is used. A mechanical sensor 23 identifies the location of a packaging part by raising a sensor arm 24 through contact with a forward or rearward surface 25 of a packaging part 26. This can be calibrated to assure that the correct position is achieved before advancement under the print roller.

While the foil web seen from above has rectangular lids, the foil web could naturally also comprise packaging parts of other shapes, such as round, triangular, oval parts, etc., and the packaging parts could be other than lids, e.g. trays, tubs, etc.

The packaging parts lie relatively close to one another, and in one example at a distance of about 10 mm. This distance will naturally depend on the shape of the packaging part. The upper wheel set 6 is seen gripping down on the foil between the rows or at each side outside the outermost row of lids, and with a pair placed on each its side of the printing section. The packaging parts are formed in the foil so that they form longitudinal, parallel rows 13 and also parallel rows 14 in the lateral direction.

Figure 1:
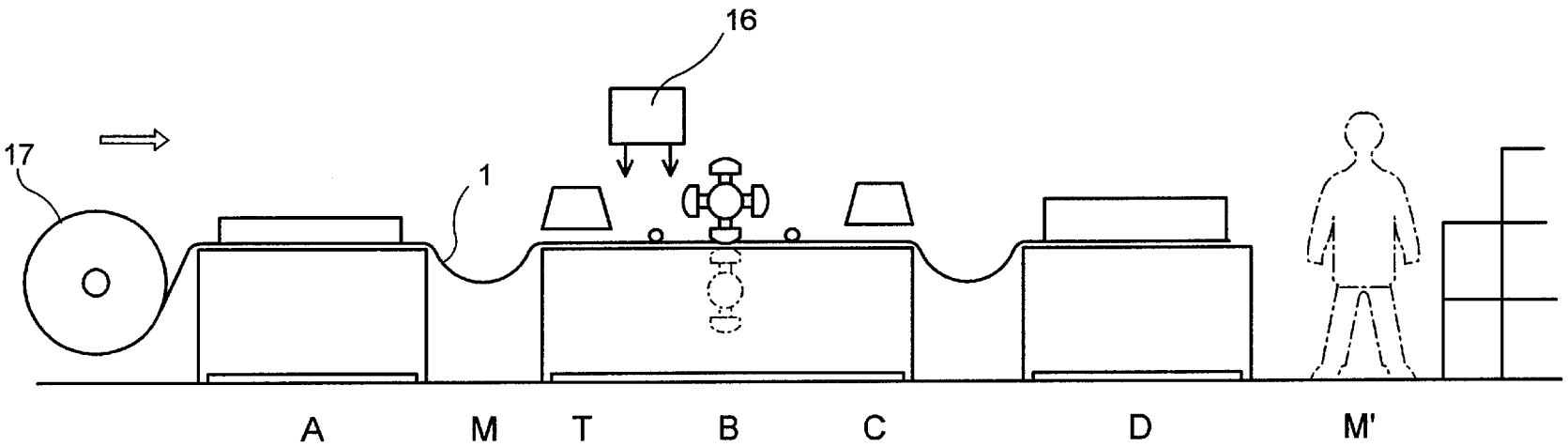

As will appear from FIG. 1, after the foil has been printed it will then move further forwards to a drying section, shown with a C, hereby ensuring that the applied print remains permanently on the lid. By allowing the foil to hang in a loop after the drying section, it is achieved that the punching-out process in the separation section D, which follows after the drying, can take place continuously, the hanging foil ensures that tension in the foil stemming from the handling in one section is not transferred to the next section with subsequent disturbing effects.

The foil is controlled in the punching-out section following the same principle as that in the printing machine, so that setting-up time can also be saved here when changing over to lids of another shape, in that expedient use is made of a twin-spindle motor control whereby various calculations can be made. The sorting out of bad lids can be effected by skipping the punching-out section, and instead feeding the whole web further to granulators or roll winders. Bad lids can, for example, be lids where the foil, the forming or the printing are not in order. Optical equipment can be mounted for the checking of the items produced, whereby the optical equipment compares the picture of the foil web with another picture which has previously been scanned, and thereby registers any irregularities.

After the punching-out, a manual or automatic packing of the packaging parts is performed. In addition to the packing, this process can also include the checking of the packaging parts.

Utilizing the present invention, precise alignment of the print roller is achieved by sensing an edge of the packaging part and calculating the precise amount of travel necessary to advance the foil for alignment with the print roller. This avoids misalignments and increases the tolerances acceptable to placement of the packaging parts on the foil web. Thus, time is saved in the printing of the articles avoiding substantially the misprinting of items.

I claim:

1. A method for printing packaging parts (2) comprising;

providing packaging parts having at least two differently disposed surface levels (3, 4) in a vertical direction, the packaging parts (2) being a part of a continuous foil web (1), the packaging parts (2) lying at a distance from each other and being in connection with one another via the foil web, feeding the continuous foil web with the packaging parts forward towards a printing section (B), sensing a preselected portion of the packaging parts and stopping the feeding of the continuous foil web, calculating a position for printing a preselected number of the packaging parts in the printing section, advancing the foil web such that the preselected number of packaging parts arrive at the calculated position for printing and simultaneously sensing another preselected number of packaging parts to be printed which are stopped at an entrance to the printing section, and calculating a position for printing the preselected number of packaging parts stopped at the entrance to the printing section such that they are subsequently precisely advanced to the calculated position for printing.

2. Method according to claim 1, characterized in that the packaging parts (2) form at least one longitudinal parallel row (13), and at least one lateral parallel row (14).

3. Method according to claim 1, further comprising providing guide elements on the foil web to laterally stabilize the continuous foil web.

4. Method according to claim 1, further comprising, during movement, retaining the continuous foil web with packaging parts using gripping elements (5).

5. Method according to claim 4, characterized in that the gripping elements (5) comprise wheel sets, said wheel sets having pairs of wheels, and in that the wheels in each pair are placed on each side of the foil web (1) and in contact with the foil web, forming an upper wheel set (6) and a lower wheel set (7) lying opposite each other, said upper wheel set (6) being spring-loaded, and said lower wheel set (7) being motor-driven.

6. Method according to claim 1, characterized in that the printing section (B) comprises at least one print-pad (10), and at least one counter-pressure dolly (12), said print-pad and counter-pressure dolly being mounted on rotatable drums (8, 9), and wherein a print-pad (10) and a counter-pressure dolly (12) lie opposite each other during printing.

7. Method according to claim 1, characterized in that the packaging parts (2) are lids for packing, each lid having a lid surface (3) and an edge (4) displaced on another level in relation to the lid surface (3).

8. Method according to claim 1 further comprising printing of the packaging parts (2) in the printing section using print-pads (10).

9. Method according to claim 1 further comprising feeding the printed packaging parts forward to a separation section (D), where the individual packaging parts are separated from the foil web.

10. Method according to claim 9, characterized in that the separation section (D) comprises a punching machine, said punching machine blanking the packaging parts out of the foil.

11. Method according to claim 1, further comprising drying the packaging parts after the printing section (B) and before the separation section (D).

12. Method according to claim 1 wherein the step of sensing is performed using a light source disposed on one side of the foil web and a light detector disposed on the other side of the foil web.

13. Method according to claim 1 wherein the step of sensing is performed using a light source disposed above the foil web and having means for detecting a change in reflection corresponding to the presence of the packaging parts therebeneath.

14. Method according to claim 1 wherein the step of sensing is performed by a mechanical sensor which engages a portion of the packaging parts passing thereby.

15. Method according to claim 1 wherein the step of calculating the position of the packaging parts is performed by a controller which receives a signal from a sensing means and outputs a signal to a motor controlling the advancement of the foil web.

16. Method according to claim 5 wherein said wheel sets have four pairs of wheels.

17. Method according to claim 2, characterized in that the printing section (B) comprises at least four print-pads (10) per longitudinal row of packaging parts, and at least two counter-pressure dollies (12), said print-pads and counter-pressure dollies being mounted on rotatable drums (8, 9), and wherein a print-pad (10) and a counter-pressure dolly (12) lie opposite each other during printing.

* * * * *